US005193516A

United States Patent [19]

Zimmermann et al.

[11] Patent Number: 5,193,516

[45] Date of Patent: Mar. 16, 1993

[54] METHOD OF AND DEVICE FOR CONTROLLING AN INTERNAL COMBUSTION ENGINE

[75] Inventors: Jürgen Zimmermann, Schwieberdingen; Bernard Bauer, Friolzheim, both of Fed. Rep. of Germany

[73] Assignee: Robert Bosch GmbH, Stuttgart, Fed. Rep. of Germany

[21] Appl. No.: 687,921

[22] PCT Filed: Nov. 15, 1989

[86] PCT No.: PCT/DE89/00714

§ 371 Date: Jun. 24, 1991

§ 102(e) Date: Jun. 24, 1991

[87] PCT Pub. No.: WO90/07057

PCT Pub. Date: Jun. 28, 1990

[30] Foreign Application Priority Data

Dec. 31, 1988 [DE] Fed. Rep. of Germany ..... 3841862

[51] Int. Cl.[5] ..... F02P 3/12

[52] U.S. Cl. ..... 123/643; 123/620

[58] Field of Search ..... 123/643, 620, 641, 605

[56] References Cited

U.S. PATENT DOCUMENTS 4,979,487 12/1990 Fukui ..... 123/643

5,009,213 4/1991 Di Nunzio et al. ..... 123/620

5,042,449 8/1991 Dassetto ..... 123/641

5,052,358 10/1991 Fukui ..... 123/414 X 5,060,623 10/1991 McCoy ..... 123/605

5,065,729 11/1991 Krauter et al. ..... 123/643

*Primary Examiner*—Raymond A. Nelli

*Attorney, Agent, or Firm*—Michael J. Striker

[57] ABSTRACT

To control the ignition of an internal combustion engine the ignition of a spark plug is determined by means of one ignition coil assigned to each spark plug, of a first counter which, on the occurrence of an angle-fixed reference mark, is counted upwards or downwards starting from a predeterminable value by means of an angle-dependent timing signal for triggering the ignition of a spark plug in the internal combustion engine, the spark plug to be fired in each case being determined via a cylinder recognition system. The start of charging of all the ignition coils of the internal combustion engine is initiated by means of a further counting device, the count of which changes the conditioned-by-the-angle-dependent timing signal, and which in each case is assigned a starting value which corresponds to the gap up to the start of charging of the next coil. Thus while the first counting device triggers the ignition process, the second counting device determines when the charging process of an ignition coil begins.

7 Claims, 3 Drawing Sheets

METHOD OF AND DEVICE FOR CONTROLLING AN INTERNAL COMBUSTION ENGINE

BACKGROUND OF THE INVENTION

The invention concerns a method of controlling the ignition of an internal combustion engine, as well as a device for controlling the ignition of an internal combustion engine.

In the case of known processes for controlling the ignition of an internal combustion engine or known ignition control devices, the individual spark plugs are triggered via a distributor. If the internal combustion engine has many cylinders, and in the case of high engine speed, the closing or dwell angle is often no longer sufficient to charge the coil adequately.

It has therefore been attempted, by means of a so-called static distribution which makes do without a distributor rotor, to extend the dwell angle, even in the case of high engine speeds. Here, single-spark coils were used each connected for activating a spark plug. With such a control system, however, problems arise whenever more than one coil is to be charged simultaneously. Elaborate control is required in order to enable such an operational mode. Ignition control devices which permit overlapping dwell angles must be equipped with as many counters as there are ignition coils to be charged. This has the disadvantage that the control devices become not only very large, but also very expensive. Moreover, the computing time for control programs which must be provided for such control devices becomes very long. Other functions which the device must also undertake are thus impaired.

SUMMARY OF THE INVENTION

The process of controlling an internal combustion engine according to the invention has the advantage that with a control device of relatively simple construction, the ignition of internal combustion engines in particular of those with more that 6 cylinders can be triggered without problem, even at high speeds. It is particularly advantageous that for all ignition coils, only a first counting device or counter is required for triggering the ignition, and a second counting device or counter is required for starting the charging process of the ignition coils. Although each individual ignition is not equipped with its own counter, a dwell angle overlap can be easily achieved.

In a preferred embodiment of the invention, the count of the second counter is reduced step by step by a crankshaft angle dependent timing signal. The charging process of a coil is initiated as soon as the count of the second counter takes on the value ZERO. At the same time, a starting control value which has been computed for the next ignition coil, is input into the second counter. The higher is the input starting value the later is the commencement of the charging process for the next coil. Thus the start of the charging process in respective coils can be controlled through the selection of the starting values successively loaded into the second counter. It is evident that this type of control is particularly easy to carry out.

An especially preferred embodiment of the method of the invention is characterized by the fact that the starting value for a coil in a next ignition cycle can be calculated in advance during one or more, preferably two, crankshaft revolutions, using the equation $$A1 = 720° - (A2R + A3 + A4 + \ldots + An + {}_s)$$

wherein

A1 represents the value of a control interval between the start point SPn of the charging process for the last coil n within a current ignition cycle and the charge starting point SP1′ for the first coil 1 in the next ignition cycle, and $_s$ denotes the closing angle of the first coil 1. AR2 denotes the residual value of the control interval A2 remaining in the second counter at the instant when the ignition triggering time point T1 for the first coil 1 has been reached in the first counter. Similarly, A3, A4 to An denote the charge control interval values of the coils 3 through a within the current ignition cycle. It can be seen from the equation that the expenditure for determining the next charge control interval for a coil is relatively low and, consequently, the control process is very simply to realize.

The control device for carrying out the method of this invention has the advantage in contrast to known ignition control devices, that given any number of cylinders to be triggered, it has only two counters The first counter serves to to control the charging process of a coil.

The novel features which are considered as characteristic for the invention are set forth in particular in the appended claims The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
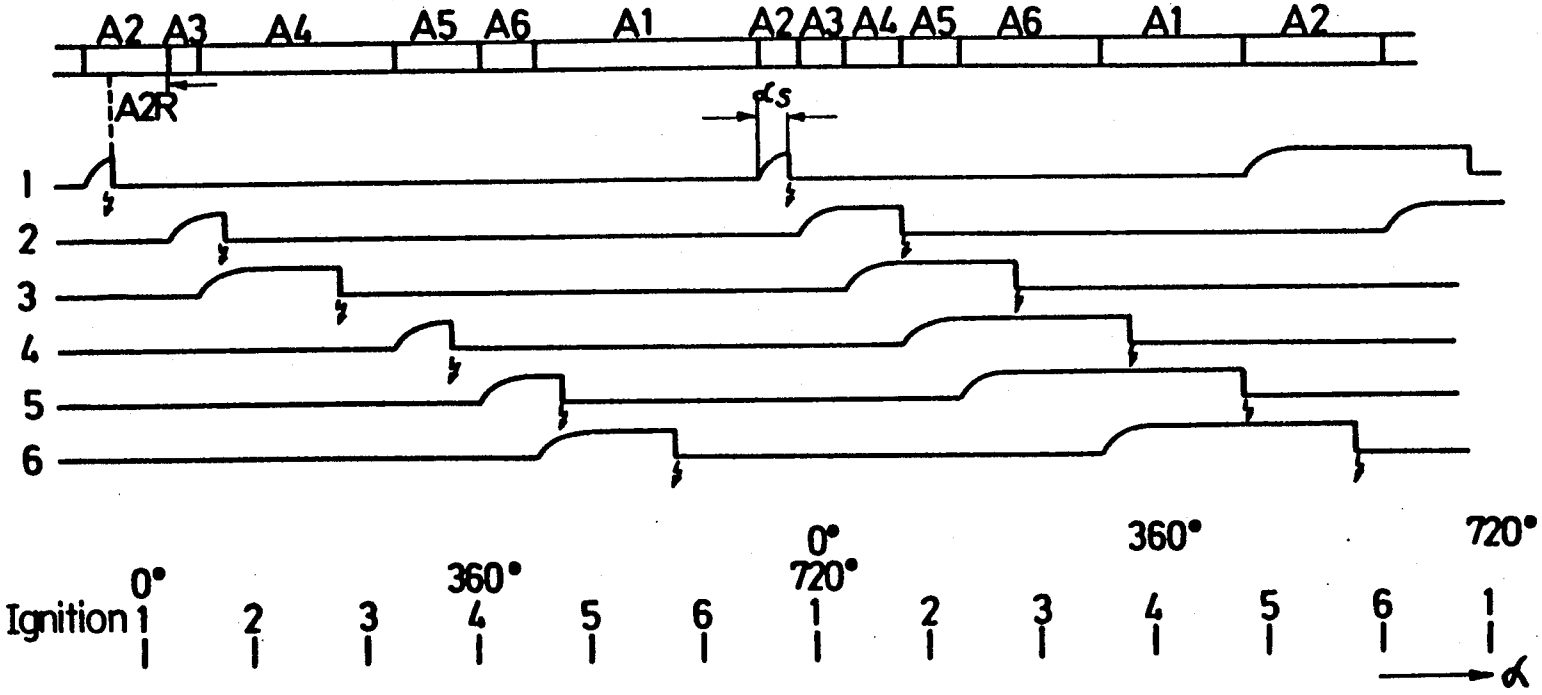
FIG. 1 shows a plot diagram of ignition control process according to the invention for a six cylinder internal combustion engine.

FIG. 1 shows a plot diagram of the crankshaft versus the voltage curves V1 to V6 on six single spark coils of an ignition control device for a six cylinder internal combustion engine. The voltage curve on the coil of the sixth cylinder for example, is indicated by V6 in FIG. 1. It can be clearly seen how the voltage at the individual coils rises and abruptly falls when the corresponding spark plug is triggered.

The diagram in FIG. 1 is not intended to depict a realistic operational case; rather, it is intended here to represent a dwell or closing angle overlap, i.e. the operational case in which several ignition coils are charged simultaneously. Viewed from left to right, in the first ignition cycle T1 to T6 of the coils 1 to 6, there is a closing angle overlap between the second and third coil, and then again between the first and sixth coil. In the subsequent ignition cycle T1′ to T6′ shown on the diagram, there is a closing angle overlap between the coils 2 and 3, as well as between the coils 3 and 4. Later, there is a multiple overlap of the dwell closing angle in the coils 3, 4 and 5, and then in the coils 4, 5 and 6. In the later course of crankshaft angle , there is a further closing angle overlap between the first and sixth coils.

In order to achieve optimum charging of the coils before the ignition of a spark plug, the charging process must be maintained for a predetermined time. The time is essentially always constant For the voltage curves V1–V6 on the ignition coils, correlated to the crankshaft angle, the result is that at higher engine speeds the charging process extends over a greater closing angle range than at lower engine speeds.

The charging processes represented in FIG. 1 thus extend over closing angle ranges of differing sizes.

The angle range during which a coil is charged is described as closing or dwell angle $_s$. As an example, it is shown in the voltage curve V1 of coil 1.

Control of the ignition coils is carried out as follows:

The respective ignition time points are controlled by a first counter, which at an angle-synchronous reference mark, is loaded with a predetermined count value. This value is lowered step by step by an angle-synchronous timing signal until the ZERO value is reached As soon as this is the case, the ignition of the corresponding spark plug is triggered via a suitable end stage. For example, the timing signal can be generated by means of a trigger wheel transmitter equipped with sixty teeth. The teeth are scanned by a suitable sensor. At each negative flank a pulse representing the timing signal, is sent both to the first counter and to the second counter to decrease their counts by one step.

In order to be able to determine the correct instant SP for the start of charging a coil, it is necessary to define and calculate the crankshaft angle, at which relative to a given position, the next coil should be charged The starting point of the calculation can be a crankshaft-synchronous mark, but can also be the instant T1 to Tn of ignition of the respective coils. An example calculation for the ignition time of coil 1 is set out below.

To determine the size of a crankshaft angle range or interval up to the next operational state "Charge coil", the second counter is used, into which a new initial count for controlling the next coil to be charged is input whenever a charging process of a coil is initiated. The count is decremented by one in response to angle increments of the crankshaft by an angle-synchronous timing signal. Here too the timing signal is generated, for example, by a trigger wheel transmitter, the negative flanks of which are employed for generating the pulses of the timing signal Thus when a high initial count is input into the second counter, it takes longer for the timing signal to count down to the ZERO value. The resulting crankshaft angle range up to the start of charging of the next coil after the ignition of the current coil is thus greater when a high initial count is input to the second counter. The closing or dwell angle range for the charging of the next coil is thus reduced.

This will be explained in greater detail with reference to FIG. 1.

At the beginning of an ignition and charging cycle, the second counter has been loaded with a non-illustrated initial count value A1. The count A1 of the counter is successively reduced by the timing signal until the ZERO value is reached. At this instant, as indicated by the first vertical dashed line, the charging process of coil 1 is initiated and the voltage V1 on the first coil starts increasing at the point SP1.

At the same time, the next initial count value A2 is loaded into the second counter After the new count A2 in the second counter has been decremented to ZERO, the charging process for the second coil is initiated. The corresponding rise in the second voltage curve V2 can be seen at the point SP2. As soon as the count A2 has reached the ZERO value, a corresponds to the angle interval extending up to the commencement point SP3 of charging of the coil 3. It can be clearly seen on the voltage curves V2 and V3 that the voltage on the third coil rises when the second coil is still being charged. There is thus a dwell or closing angle overlap Subsequently the initial count values A4, then A5 and finally A6 are input to the second counter.

The various initial count values A1 to A6 are stored in a suitable memory, for example in a RAM.

The consecutive initial count values which determine the angle intervals between the commencement points SPn of the charging process of consecutive ignition coils, have been calculated in advance during the preceding ignition and charging cycle. In the embodiment shown here, the calculation of the starting value A1 to A6 is carried out 720° in advance, whereby 720° of crankshaft rotation correspond to one ignition and charging cycle.

If the individual initial count values are calculated a full cycle in advance, a maximum of n-1 dwell angle overlaps can occur, where n corresponds to the number of cylinders. In order to achieve better dynamics for the process, the calculation of the initial count values can also be carried out at other time points, at about only 360° in advance. However, in such a case, the number of possible dwell angle overlaps is reduced.

In the embodiment shown in FIG. 1, the initial count values A1, A2, . . . , A6 had already been calculated and stored in a memory. The calculation of the new initial counts A1' to A6' for the following ignition and charging cycle will be explained on the basis of the next initial count A1' for the coil 1:

The new initial count A1' is calculated in accordance with the following equation:

$$A1 = 720° - (A2R + A3 + A4 + A5 + A6 + {}_{s1}).$$

As stated above, in this design example it is assumed that the calculation of the initial count A1 was started at the instant of ignition of coil 1. Similarly, the count value A3 was calculated in response to the ignition of coil 2, and so on.

As explained before, with the start of the charging process of coil 1, the initial count A2 is input to the second counter. The counter is counted down by the angle-synchronous timing signal. At the instant of ignition of coil 1, the count A2 has reached a residual value A2R.

In FIG. 1 the initial counts A1 to A6 corresponding to crankshaft angle intervals are shown above the voltage curves V1–V6 of the coils 1 to 6. From the first ignition process at the left of the diagram of coil 1 up to the subsequent ignition process, there are two rotations of the crankshaft. Thus, on the crankshaft angle axis, running horizontally a displacement by 720° correspond to one ignition and charging cycle. It can now be seen that the next initial count A1' pertaining to coil 1 can be calculated by subtracting the sum of the residual running count value A2R, the initial count value A3, A4, A5 and A6, as well as the dwell angle $_{s1}$ of the first coil from the full ignition and charging period of 720°.

The newly calculated initial count value A1' for coil 1 is stored in the memory for the starting values.

Similarly, the starting value A2' for the second coil can be calculated. However, it can be seen from FIG. 1 that the count value A3 has already completely run down to ZERO as the ignition process of the second coil is initiated. Thus the residual running count value A4R of the fourth initial count A4 must be taken into the equation, which is as follows:

$$A2' = 720° - (A3 + A4R + A5 + A6 + A1' + {}_{s2}).$$

The dwell angles $_s$ of the individual coils are likewise stored in a suitable memory. These values can then be readily called up for the calculation of the various initial count values.

As is evident from the above statements, errors in calculation of a count value have an effect only within one ignition cycle or period. At the beginning of the next period, the starting values A1 to A6 are calculated anew, so preceding errors no longer have any effect. It is thus apparent that this process, or an ignition control device working in accordance with this process, is largely immune to faults. It is therefor not necessary to monitor the calculation.

It is also apparent that the second counter, which in this embodiment counts down from a predetermined initial count value, can also be designed to count upwards. The charging of a coil must then in each case be triggered when the corresponding initial count is reached. In any case, comparators are necessary which determine whether the second counter has reached the ZERO value or the predetermined starting value. When this is the case, the corresponding charging process is triggered.

The process of this invention is not restricted to six cylinder internal combustion engines. There can thus be any number of cylinders. Moreover, the process described here can be applied not only to static ignition distribution, but also to so-called dual circuit distributions or distributors with rotating systems. It can also be used with double-spark coils.

Figure 2:
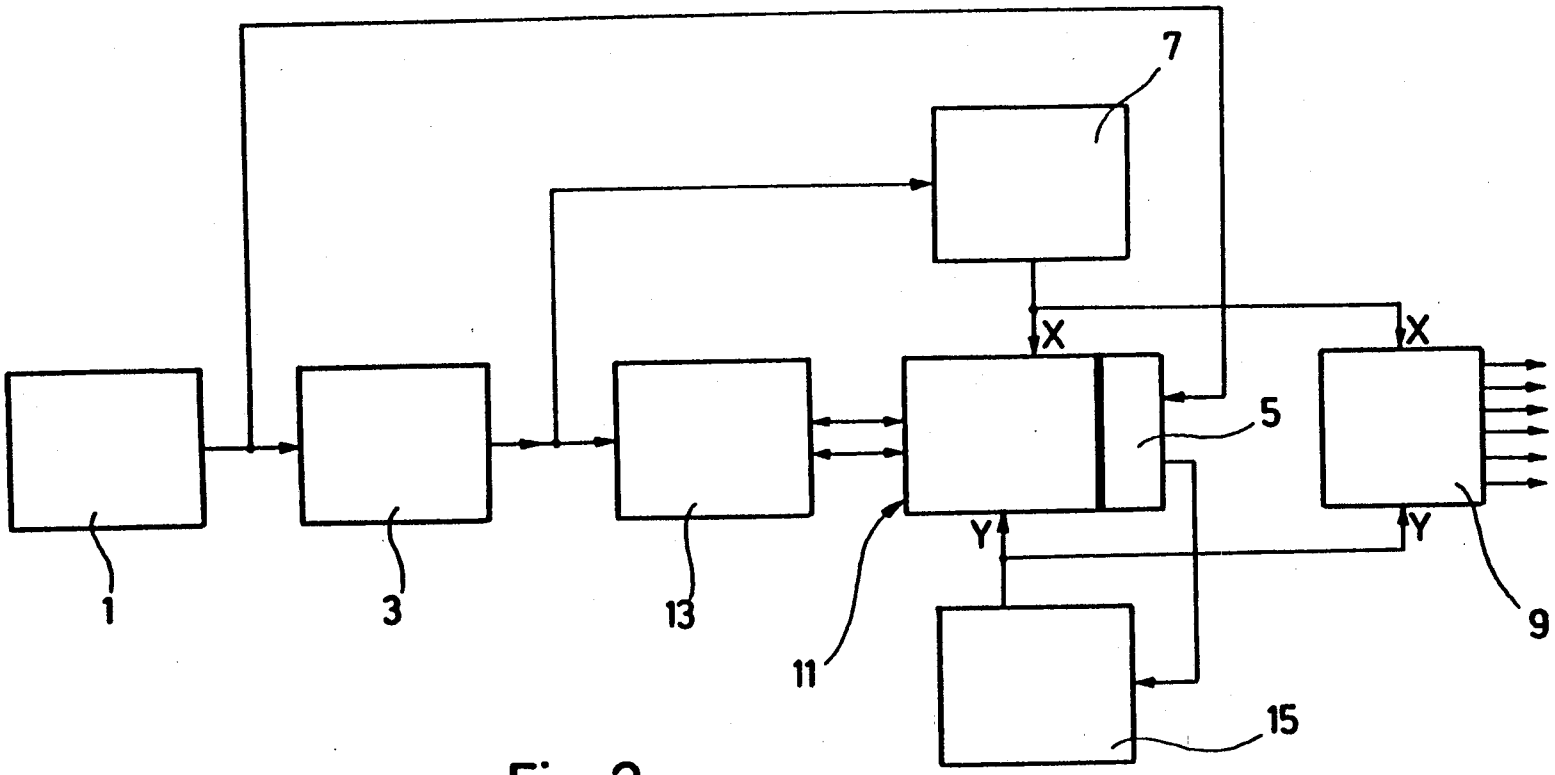
FIG. 2 is a block circuit diagram of an embodiment of the device for carrying out the method of FIG. 1.

An ignition control device working in accordance with this invention will be explained with reference to FIG. 2, which shows a block diagram of such a control system.

For example, with a trigger wheel transmitter 1 running angle-synchronously, an angle-interrupt signal or an angle increment signal is generated, which is passed on to a first counter 3 and to a second counter 5. It was explained above that the instants T1 to T6 of ignition are determined by means of the first counter 3. This is loaded with an initial count value which, on reaching an angle-fixed reference mark, is reduced step-wise to ZERO. As soon as the ZERO value is reached, the ignition process is triggered by a signal being sent to a first address pointer 7, which gives an output signal x to an end stage 9, which ignites the corresponding spark plug. At the same time, the first pointer 7 sends the output signal x to a register 11 which is associated with the second counter 5. This output signal ensures that a value calculated in the calculator or adder 13 is stored in the correct memory cell.

It is also clear from the above that the second counter 5 is counted step by step downwards, starting from an initial count value, by means of the signals from the trigger wheel, until the value ZERO is reached.

In register 11 the addresses for the calculated initial count values A1 to A6 are indicated.

The adder 13 serves to calculate the initial count values in accordance with the equation given above. The calculation is carried out whenever the first counter 3 has reached the ZERO value and an ignition process has been triggered. Thus when coil 1 has triggered an ignition process, the next initial count A1' for coil 1 is calculated and stored in register 11 at that location which is assigned to the next value A1'. Storage at the correct address is ensured by the output signal x of the first pointer 7.

As soon as the second counter 5, starting from an initial count value Ax, and on the basis of signals from the trigger wheel transmitter 1, has reached the value ZERO, the next initial count A(x+1) is loaded into the second counter 5. An output signal sent from the second counter 5 to a second pointer 15, ensures that the correct output value from register 11 is loaded into the second counter 5. At the same time, the output signal y from the second pointer 15 is sent to the end stage drive 9 of the control device, so that the correct coil begins the charging process.

Figure 3:
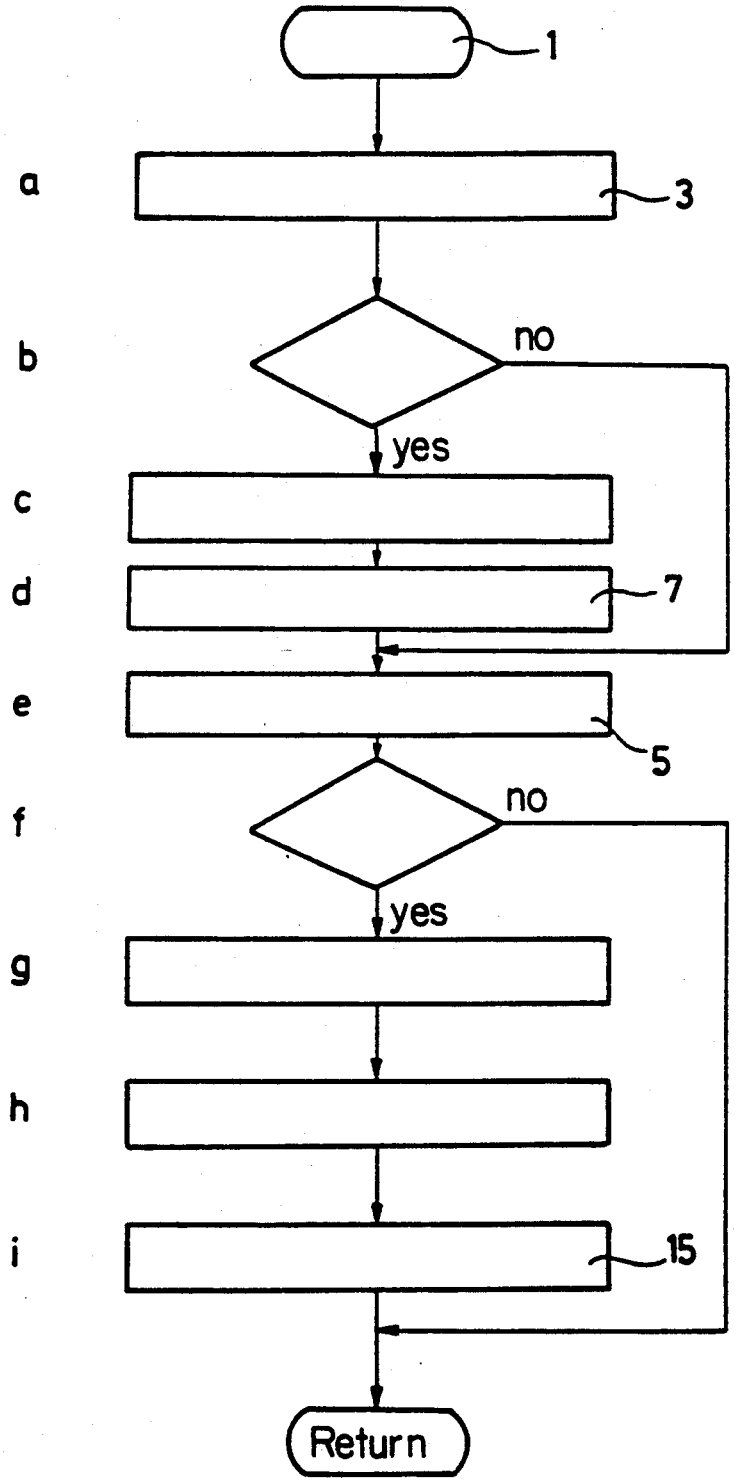
FIG. 3 is a flow chart of the control process of FIG. 1.

The process which is the subject of this invention and operation of the ignition control device for executing this process, are explained by way of an example in the flow diagram of FIG. 3. In order to facilitate understanding, identical parts in FIGS. 1, 2 and 3 are marked with the same reference numbers.

In the flow diagram it is assumed that an angle-interrupt signal S1 from transmitter 1 is directed to a first counter 3.

By means of the angle-interrupt signal in a first step a, the count COUNT3 of the first counter 3 is lowered by one. In the next step b it is inquired whether the COUNT3 has reached the ZERO value. If this is the case, the next initial count A1' for use in the second counter 5 is calculated in step c in accordance with the equation explained on the basis of FIG. 1. This value is stored in register 11 of the second counter 5. At the same time, the spark plug assigned to coil 1 is fired. Then, in a step d, the address x in the first point 7 is incremented by one, i.e. from x to x+1.

In the next step e, the count A2 of the second counter 5 is reduced by one. This is carried out directly if it has been ascertained in step b that the first counter 3, acting as the ignition control counter, has reached the value ZERO.

Then, in step f, it is inquired whether the second counter 5 has taken on the value ZERO. If this is the case, in a next step g, the coil 2 is switched on in accordance with the address y at second pointer 15, and its charging process is started.

In a further step h, the contents of the memory cell at the address Y in register 11 is input to the second counter 5.

Finally, in step i, the address Y at the second pointer 15 is incremented by one whereupon the whole program is returned to step a.

If, in the course of the inquiry in step f, it transpires that the count of the second counter has taken on the value ZERO, the program is immediately run through from the beginning.

It is clear from all the above that, with the process for controlling the ignition of an internal combustion engine and with the described ignition control device, a simple solution for controlling the ignition of an internal combustion engine has been found, even for overlapping dwell angles. The ignition control device is characterised in particular by the fact that only two counters are required for on/off switching of the coils of the ignition device. This means a considerable simplification of the hardware and thus a reduction of the device's susceptibility to faults. Moreover, the costs of such a device have been considerably reduced, since in the case of known devices, a separate counter had to be provided for each coil.

From the above, it is immediately apparent that the counting devices or counters can be realised not only by means of hardware but also by means of suitable software.

It will be understood that each of the elements described above, or two or more together, may also find a useful application in other types of methods and constructions differing from the types described above.

While the invention has been illustrated and described as embodied in a process of and a device for controlling ignition of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of controlling ignition of an internal combustion engine having a plurality of cylinders each provided with a spark plug, a plurality of ignition coils each connected to an assigned spark plug, means for determining individual spark plugs to be fired during an ignition cycle, means for charging individual ignition coils prior to firing the spark plugs assigned to them, means for generating a pulse-shaped timing signal whose pulse rate depends on angular velocity of the engine, and a first counting device for one of incrementing or decrementing the pulses of the timing signal until an ignition triggering count corresponding to a fixed angular interval of engine rotation is reached, the method comprising the steps of storing in a memory a set of starting values for defining the start of charging of consecutive ignition coils during an ignition cycle; loading a second counting device with a first initial count corresponding to the stored starting value for a first ignition coil to be triggered decrementing the first initial count by said timing signal until a given reference count value is reached whereupon the charging of the first ignition coil is initiated, loading the second counting device with a new initial count corresponding to the stored starting value for the next ignition coil and counting down the new initial count by the timing signal; firing via said first ignition coil the assigned spark plug as soon as the ignition triggering count is reached on said first counting device, restoring one of incrementing or decrementing of said first counting device and at the same time, calculating a new charge starting value for said first ignition coil and storing the calculated value for use in the next ignition cycle; and upon loading the second counting device with the stored charge starting value pertaining to the last ignition coil to be triggered and upon decrementing it to said given reference count value, repeating the above steps with the calculated new set of charge starting values retrieved from the memory.

2. A method as defined in claim 1, wherein said given reference count of the second counting device is zero count.

3. A method as defined in claim 1, wherein an additional spark plug is assigned to each of said ignition coils.

4. A method as defined in claim 2, wherein a residual value of a count in said second counting device at the instant of triggering of a preceding coil is added to starting values of the subsequent coils during the calculation of the charge starting value of the preceding coil for the next ignition cycle.

5. A method as defined in claim 4, further comprising the step of calculating at least one crankshaft rotation in advance, the starting value for a coil from the following equation $$A1=720^\circ-(A2R+A3+A4+\ldots+An'\alpha_s),$$

wherein A1 is an initial count value to be loaded into the second counting device for charging the first coil in the next ignition cycle, A2R is the residual running count value for the second coil, $\alpha_s$ is the dwell angle of the first coil, and A3 through An are the initial count values for the remaining coils during the running ignition cycle.

6. A control device for controlling ignition of an internal combustion engine having a plurality of spark plugs, a plurality of ignition coils, each one of said ignition coils having at least one of said spark plugs assigned to it, comprising means for generating a pulse-shaped timing signal whose pulse rate depends on angular velocity of the engine; a first counting device for one of incrementing or decrementing the pulses of the timing signal until an ignition triggering count corresponding to a fixed angular interval of engine rotation is reached; cylinder recognition means for determining individual spark plugs to be fired during an ignition cycle; means for storing a set of starting values for defining the start of charging of the respective coils; a second counting device for controlling the start of charging of all coils; means for loading said second counting device with a starting value for a coil; said timing signal decrementing or incrementing the loaded starting value until a given reference count is reached; and means for starting in response to said reference count the charging of said coil and for loading into said second counter a new starting value for the next coil.

7. A method as defined in claim 6, and further comprising means for calculating the next starting value for said determined coil at the instant when said ignition triggering count in the first counting device is reached, and means for directing said next starting value into said storing means.

* * * * *